US010557347B2

(12) United States Patent
Gross

(10) Patent No.: US 10,557,347 B2
(45) Date of Patent: Feb. 11, 2020

(54) ROPE CAM DIPPER

(71) Applicant: Harnischfeger Technologies, Inc., Wilmington, DE (US)

(72) Inventor: Matthew L. Gross, West Allis, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 303 days.

(21) Appl. No.: 15/454,980

(22) Filed: Mar. 9, 2017

(65) Prior Publication Data

US 2017/0260857 A1 Sep. 14, 2017

Related U.S. Application Data

(60) Provisional application No. 62/306,263, filed on Mar. 10, 2016.

(51) Int. Cl.

| | |
|---|---|
| ***E21C 27/30*** | (2006.01) |
| ***E21C 47/00*** | (2006.01) |
| ***E02F 3/30*** | (2006.01) |
| ***E02F 3/40*** | (2006.01) |
| ***E02F 3/42*** | (2006.01) |

(52) U.S. Cl.

CPC ..... *E21C 27/30* (2013.01); *E02F 3/308* (2013.01); *E02F 3/40* (2013.01); *E02F 3/427* (2013.01); *E21C 47/00* (2013.01)

(58) Field of Classification Search

CPC .. E02F 3/308; E02F 3/40; E02F 3/427; E21C 27/30; E21C 47/00

See application file for complete search history.

(56) References Cited

U.S. PATENT DOCUMENTS 1,008,247 A * 11/1911 Dowd ..... E02F 3/60 37/396
1,405,796 A * 2/1922 Middlemiss ..... E02F 7/026 200/84 R
1,529,395 A * 3/1925 Burke ..... E02F 3/304 414/693
1,609,372 A * 12/1926 Lichtenberg ..... E02F 3/40 414/726
1,867,479 A * 7/1932 Summers ..... E02F 3/40 414/692

(Continued)

OTHER PUBLICATIONS

Office Action issued by the Chilean Patent Office for related Application No. 201700580 dated Jun. 21, 2018 (11 pages including Statement of Relevance).

*Primary Examiner* — Jessica H Lutz
(74) *Attorney, Agent, or Firm* — Michael Best & Friedrich LLP

(57) ABSTRACT

A mining machine assembly includes a dipper having a main body, the main body having a front side, a back side, a bottom side, and a top side. A ground engagement portion extends from the front side, the ground engagement portion including digging teeth. The mining machine assembly also includes a hoist rope attachment assembly coupled to the dipper. The hoist rope attachment assembly is configured to directly couple a hoist rope to the dipper. The hoist rope attachment assembly includes a cam having a first portion extending from the top side of the main body of the dipper, and a second portion that extends from the first portion and away from the main body and digging teeth.

22 Claims, 13 Drawing Sheets

(56) References Cited

U.S. PATENT DOCUMENTS

| | | | | | |
|---|---|---|---|---|---|
| 2,034,854 | A * | 3/1936 | Lewis | E02F 3/40 | 414/722 |
| 2,652,940 | A | 9/1953 | Brolin et al. | | |
| 3,933,260 | A * | 1/1976 | Kronlokken | E02F 3/304 | 414/694 |
| 4,339,225 | A * | 7/1982 | Donnally | E02F 3/42 | 414/690 |
| 5,839,213 | A * | 11/1998 | Abbott | E02F 9/00 | 37/443 |
| 7,326,106 | B1 * | 2/2008 | Rogers | B24B 7/186 | 15/49.1 |
| 2013/0136570 | A1 | 6/2013 | Colwell et al. | | |
| 2015/0003950 | A1 | 1/2015 | Hren et al. | | |
| 2015/0345106 | A1 | 12/2015 | Gross et al. | | |

* cited by examiner

ROPE CAM DIPPER

CROSS-REFERENCE TO RELATED APPLICATIONS

This application claims priority to U.S. Provisional Application No. 62/306,263, filed Mar. 10, 2016, the entire contents of which are incorporated herein by reference.

BACKGROUND OF THE INVENTION

The present invention relates to mining machines, and specifically mining shovels having a dipper and a hoist rope.

Industrial mining machines, such as electric rope or power shovels, draglines, etc., are used to execute digging operations to remove material from a bank of a mine. On a conventional rope shovel, a dipper is attached to a handle, and the dipper is supported by rope that passes over a boom sheave. The rope is secured to a bail and/or equalizer that is then coupled to the dipper at a bail bushing pin joint. However, the bail bushing pin joint has consistently been a point of high wear due to high loads and rotation, thus requiring time-consuming and regular maintenance, and often resulting in significant down-time for the rope shovel. Additionally, the bail and/or equalizer consumes a significant amount of space on the rope shovel (e.g., as much as twelve feet in height), limiting an overall dig dump height for the rope shovel. Thus, there is a need for an improved system by which to couple a hoist rope to a dipper.

SUMMARY

In accordance with one construction, a mining machine assembly includes a dipper having a main body, the main body having a front side, a back side, a bottom side, and a top side. A ground engagement portion extends from the front side, the ground engagement portion including digging teeth. The mining machine assembly also includes a hoist rope attachment assembly coupled to the dipper. The hoist rope attachment assembly is configured to directly couple a hoist rope to the dipper. The hoist rope attachment assembly includes a cam having a first portion extending away from the top side of the main body of the dipper. The cam includes a second portion that extends from the first portion and away from the main body and digging teeth.

In accordance with another construction, a hoist rope attachment assembly configured to be retrofitted onto a dipper of a mining machine includes a cam having a first plate, a second plate, and a rope guide disposed between the first plate and the second plate. The hoist rope attachment assembly also includes a cam supporting structure for coupling the cam to the dipper.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
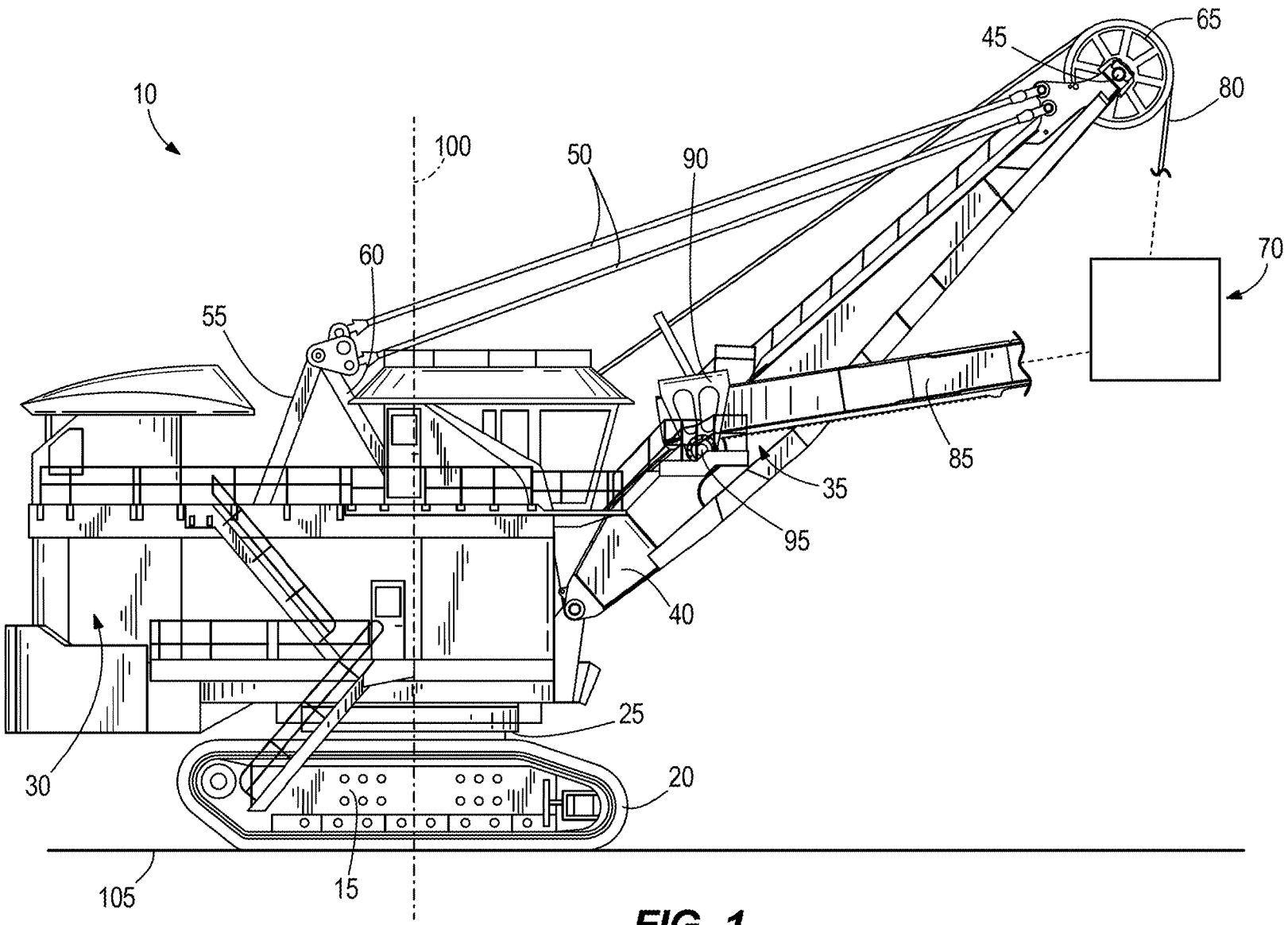
FIG. 1 is a side view of a mining machine according to one construction.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave(s) 65 rotatably mounted on the upper end 45 of the boom 35, a dipper 70 (illustrated schematically), a hoist rope(s) 80, a winch drum (not shown), a dipper handle 85, a saddle block 90, a shipper shaft 95, and a transmission unit (also called a crowd drive, not shown). The rotational structure 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The hoist rope(s) 80 is anchored to the winch drum (not shown) of the revolving frame 30, and is wrapped over the sheave(s) 65 and coupled to the dipper 70. The winch drum is driven by at least one electric motor (not shown) that incorporates a transmission unit (not shown). As the winch drum rotates, the hoist rope(s) 80 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the winch drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
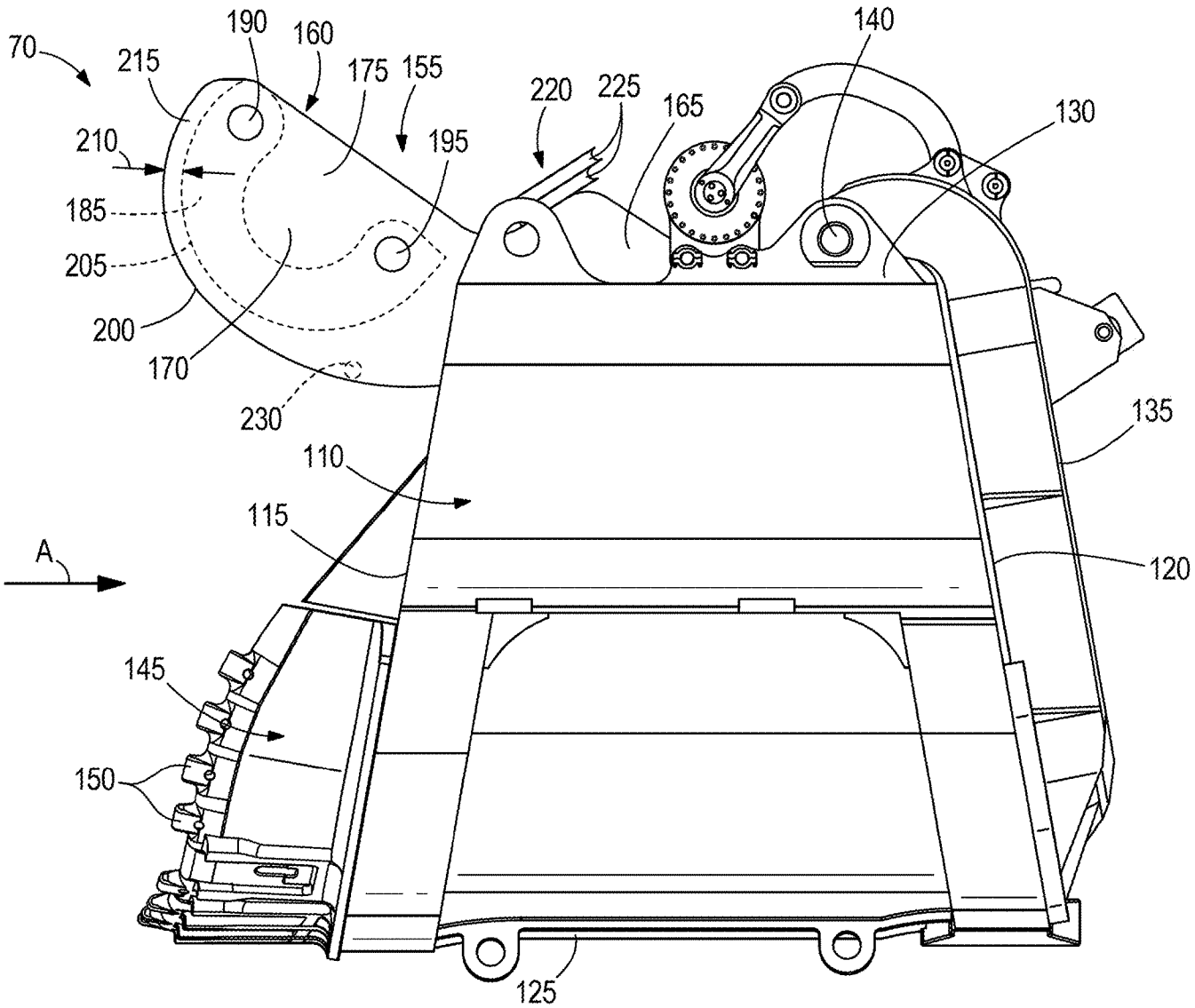
FIG. 2 is a side view of a dipper of the mining machine of FIG. 1, the dipper having a hoist rope attachment assembly according to one construction.
Figure 3:
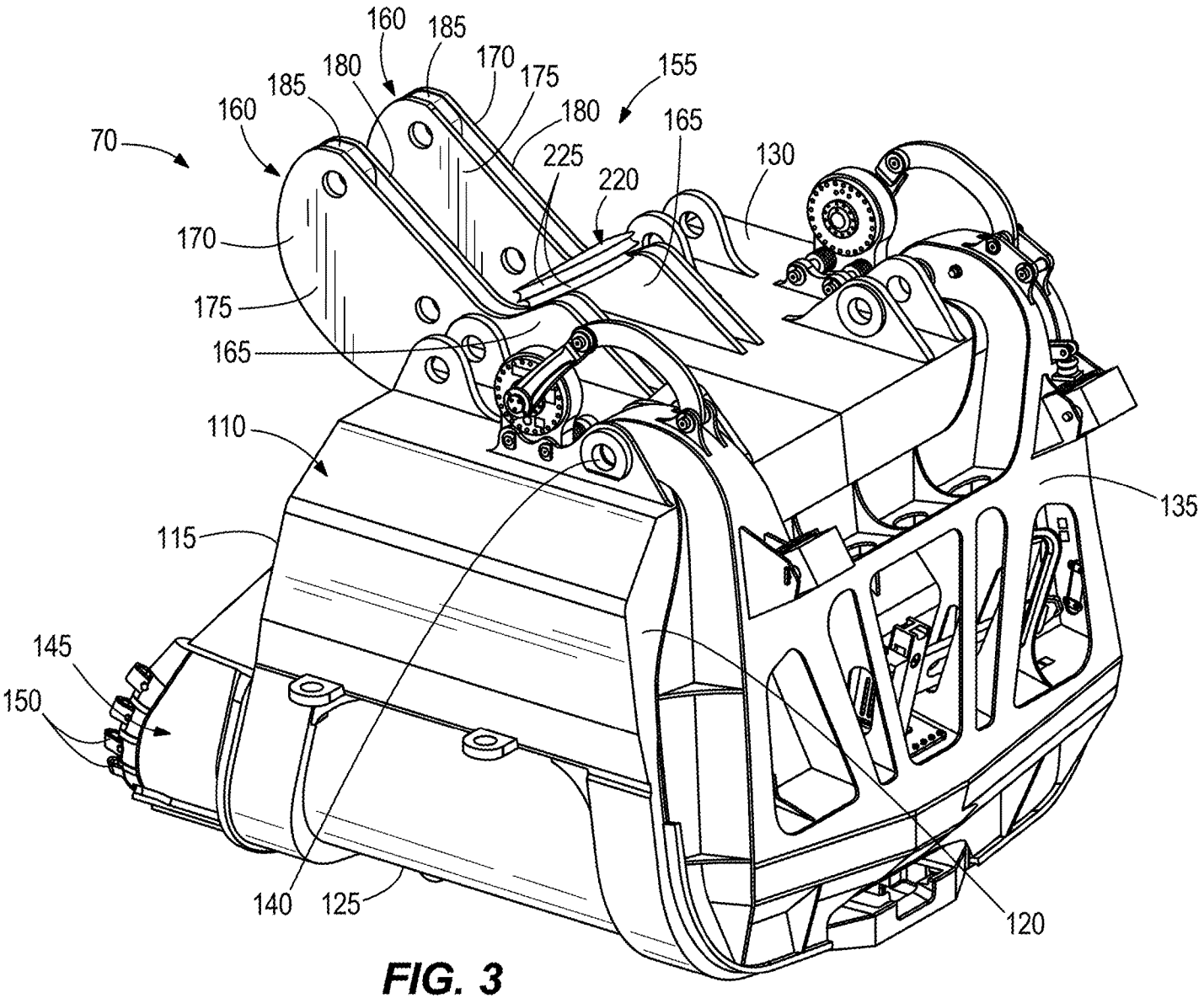
FIGS. 3 and 4 are perspective views of the hoist rope attachment assembly of FIG. 2.
Figure 4:
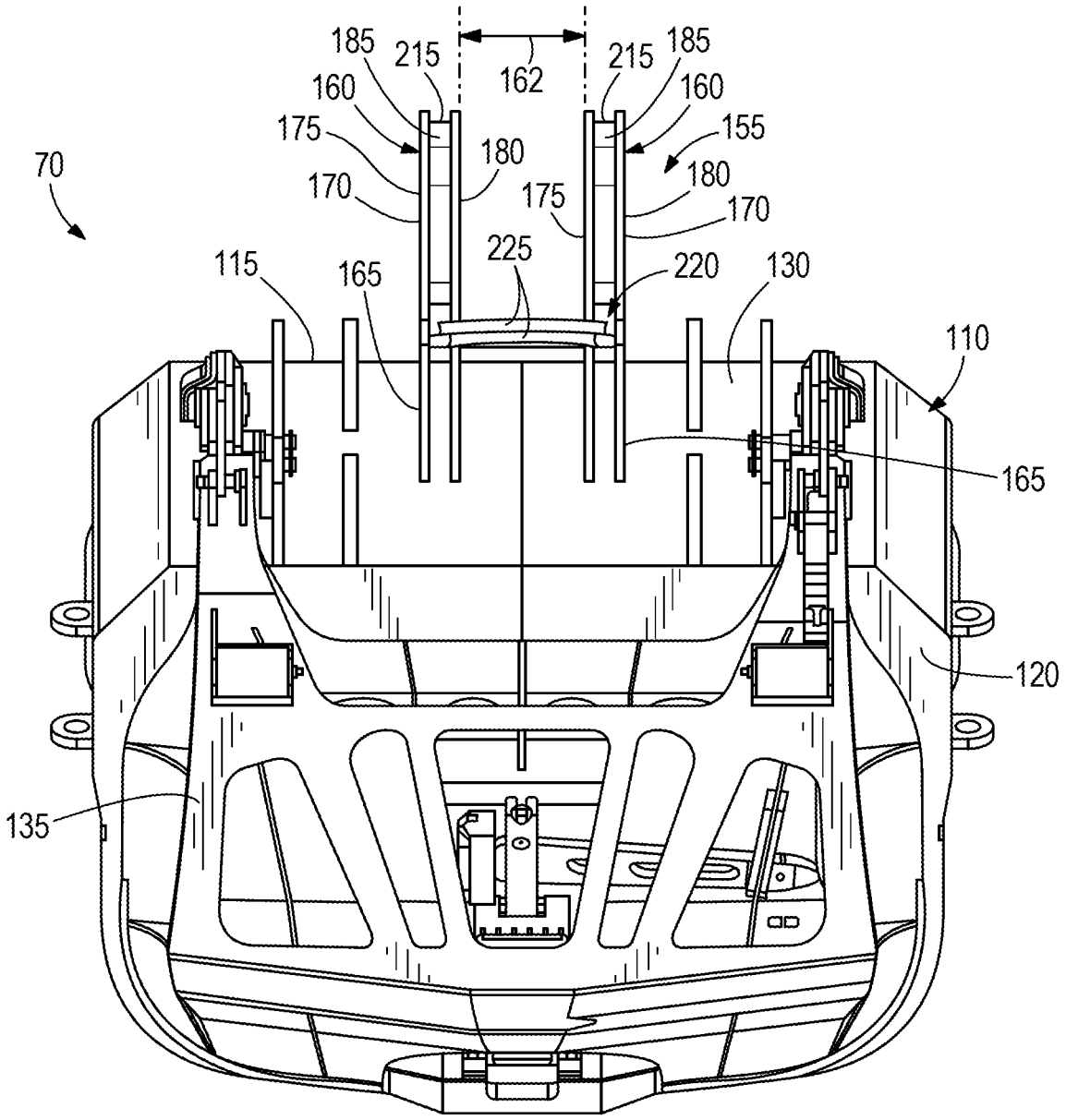
Figure 5:
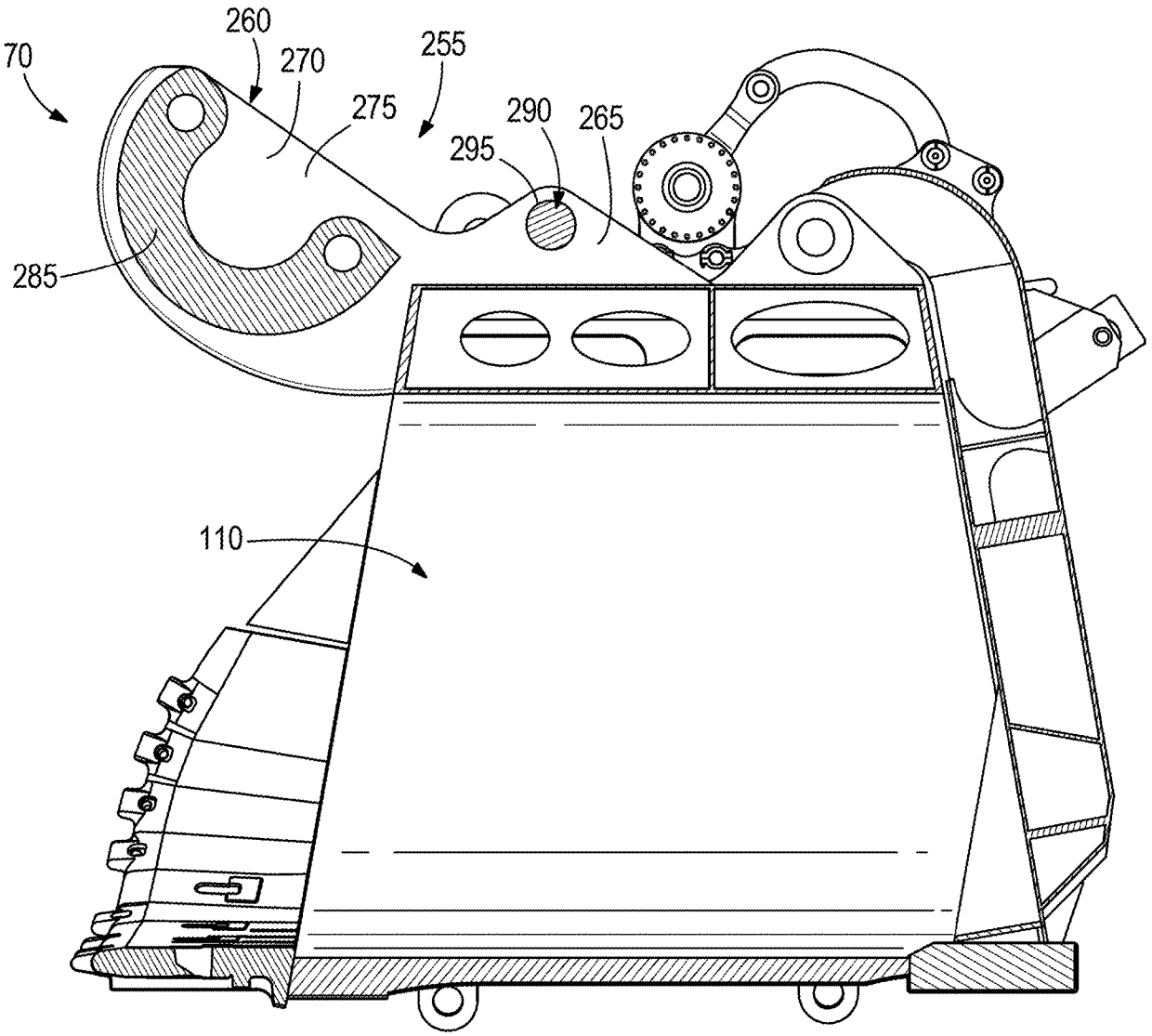
FIG. 5 is a side view of a hoist rope attachment assembly according to another construction.

FIGS. 2-4 illustrate the dipper 70 in further detail. The dipper 70 includes a main body 110 having a front side 115, a back side 120, a bottom side 125, and a top side 130. A dipper door 135 is pivotally coupled to the main body 110 about a dipper door pivot pin 140 along the top side 130. The dipper door 135 pivots from a closed position (as illustrated in FIG. 2) where the dipper door 135 is adjacent the back side 120 to an open position where the dipper door 135 is pivoted away from the back side 120, thereby exposing an interior of the main body 110.

The dipper 70 also includes a ground engagement portion 145 that extends from the front side 115 of the main body 110. The ground engagement portion 145 includes digging teeth 150 that are used to dig into a pile of material (e.g., dirt, rock, etc.) and guide the material into the main body 110.

With continued reference to FIGS. 2-4, the dipper 70 also includes a hoist rope attachment assembly 155. Typically a hoist rope is coupled directly to a bail and/or equalizer, and the bail and/or equalizer is then separately coupled to the dipper. In contrast, the hoist rope attachment assembly 155 couples the hoist rope(s) 80 directly to the dipper 70 itself.

In the illustrated construction, the hoist rope attachment assembly 155 is integrally formed as one piece with the dipper 70, and extends from both the top side 130 and the front side 115 of the main body 110. In other constructions, the hoist rope attachment assembly 155 is fixed (e.g., fastened with one or more fasteners) to the top side 130, front side 115, and/or another portion of the dipper 70.

With continued reference to FIGS. 2-4, the hoist rope attachment assembly 155 includes two cams 160 that receive the guide rope(s) 80, although other constructions include different numbers of cams 160. The cams 160 are equal in size and shape, and as illustrated in FIG. 4 are parallel to one another and spaced apart by a gap 162. In some constructions, the mining machine 10 includes two sheaves 65 at the top of the boom 35, and the two sheaves 65 are separated by a gap equal to the size of the gap 162 so as to maintain a hoist rope alignment between hoist ropes 80 passing over the sheaves 65 and over the cams 160.

With continued reference to FIGS. 2-4, each of the cams 160 includes a first portion 165 that is coupled directly to the top side 130 of the main body 110, and a second portion 170 that extends away from the main body 110. The cams 160 are positioned so as to not interfere with the loading of material into the dipper 70. Thus, while the second portions 170 of the cams 160 extend away from the main body 110, the second portions 170 do not adversely interfere with material entering the main body 110. For example, as illustrated in FIG. 2, the second portions 170 generally extend up and away from the main body 110, and in a direction away from the digging teeth 150, thereby leaving a large area within which material may enter along a direction "A" into the main body 110.

With continued reference to FIGS. 2-4, each of the cams 160 includes a first plate 175 and a second plate 180. The first and second plates 175, 180 are equal in size and shape, and as illustrated in FIG. 4, are spaced apart from one another in a parallel relationship. Each of the cams 160 also includes a rope guide 185 disposed between the first plate 175 and the second plate 180. As illustrated in FIG. 2, the rope guides 185 each have a generally C-shaped profile. The rope guides 185 are coupled to the first and second plates 175, 180 with two pins 190, 195, although in some constructions, the rope guides 185 are formed integrally as one piece with the first and second plates 175, 180, or are coupled to the first and second plates 175, 180 in other ways (e.g., with fasteners).

As illustrated in FIG. 2, the first and the second plates 175, 180 each have a curved outer surface 200 along the second portion 170 of the cam 160. The rope guides 185 also each have a curved outer surface 205. The curved outer surfaces 205 of the rope guides 185 contact and guide the hoist rope(s) 80 on the cams 160. In some constructions, the curved outer surface 205 has a radius of curvature that is greater than or equal to a radius of curvature on the winch drum, such that the cams 160 will not fatigue the hoist rope(s) 80 any more than the winch drum will fatigue the hoist rope(s) 80. In the illustrated construction, the radius of curvature is constant, although in other constructions the radius of curvature may vary. In some constructions, for example, the rope guides 185 are removable and may be replaced with different rope guides 185 having different profiles and/or radii of curvature, depending on the type of material being loaded (e.g., coal digging v. hard rock digging). In some constructions, the radius of curvature of the outer surface 205 is approximately 40 cm. In some constructions, the radius of curvature of the outer surface 205 is between 35 cm and 45 cm. Other constructions include different values and ranges.

With continued reference to FIG. 2, the outer surface 205 of each rope guide 185 generally follows or corresponds to the outer surface 200 of each of the first and second plates 175, 180 along at least a portion of the first and second plates 175, 180 on each cam 160, such that a constant gap 210 is formed between the outer surface 205 of the rope guide 185 and the outer surfaces 200 of the first and second plates 175, 180. This gap 210 forms a channel 215 that receives the hoist rope(s) 80. The hoist rope(s) 80 sits within this channel 215 and is supported and guided by the outer surface 205 of the rope guide 185, with the first and second plates 175, 180 acting as side walls along the channel 215, helping to maintain a lateral position of the hoist rope(s) 80 on the cams 160.

With references to FIGS. 2-4, the hoist rope attachment assembly 155 also includes a D-block 220. The D-block 220 is coupled to both of the cams 160, and as illustrated in FIGS. 3 and 4 extends (e.g., bridges) across the gap 162 between the two cams 160. The D-block 220 includes at least one channel 225 that receives the hoist rope(s) 80. In the illustrated construction, the D-block 220 includes two channels 225, offset from one another, with each sized to receive at least one hoist rope 80.

In some constructions, one hoist rope 80 extends from the sheave 65, contacts one of the rope guides 185, extends within a first of the channels 225 in the D-block 220, and then contacts the other rope guide 185 before returning toward the sheave 65. In some constructions, a second hoist rope 80 additionally extends from the sheave 65, contacts one of the rope guides 185, extends within a second of the channels 225 in the D-block 220, and then contacts the other rope guide 185 before also returning toward the sheave 65. In some constructions, one or more hoist ropes 80 extends from the sheave 65, contacts one of the rope guides 185, and then terminates at the D-block 220 or elsewhere on the dipper 70 (e.g., attaches to the D-block 220 within one of the channels 225 or at another location on the D-block 220). Other constructions include different numbers of hoist ropes 80 (e.g., four or more hoist ropes 80), as well as different windings and/or positions of the hoist rope(s) 80 on the hoist rope attachment assembly 155.

In some constructions, and with reference to FIG. 2, a covering structure 230 (e.g., a pin, protrusion, etc.) extends between the first and second plates 175, 180 to support or cover the hoist rope(s) 80, and to prevent the hoist rope(s) 80 from slipping or falling out of the rope attachment assembly 155 during times of no or little rope tension. In some constructions, the attachment assembly 155 includes more than one covering structure 230 per cam 160, or includes a covering structure 230 at a location other than that illustrated.

FIGS. 5-8 illustrate a different hoist rope attachment assembly 255 for use on the dipper 70. As with the hoist rope attachment assembly 155, the hoist rope attachment assembly 255 also couples the hoist rope(s) 80 directly to the dipper 70 itself. In particular, the hoist rope attachment assembly 255 includes cams 260, each having a first portion 265 coupled directly to the main body 110 of the dipper 70 and a second portion 270 that extends away from the main body 110. The hoist rope attachment assembly 255 also includes first and second plates 275, 280, and rope guides 285 disposed between the first and second plates 275, 280, similar to the hoist rope assembly 155.

Figure 6:
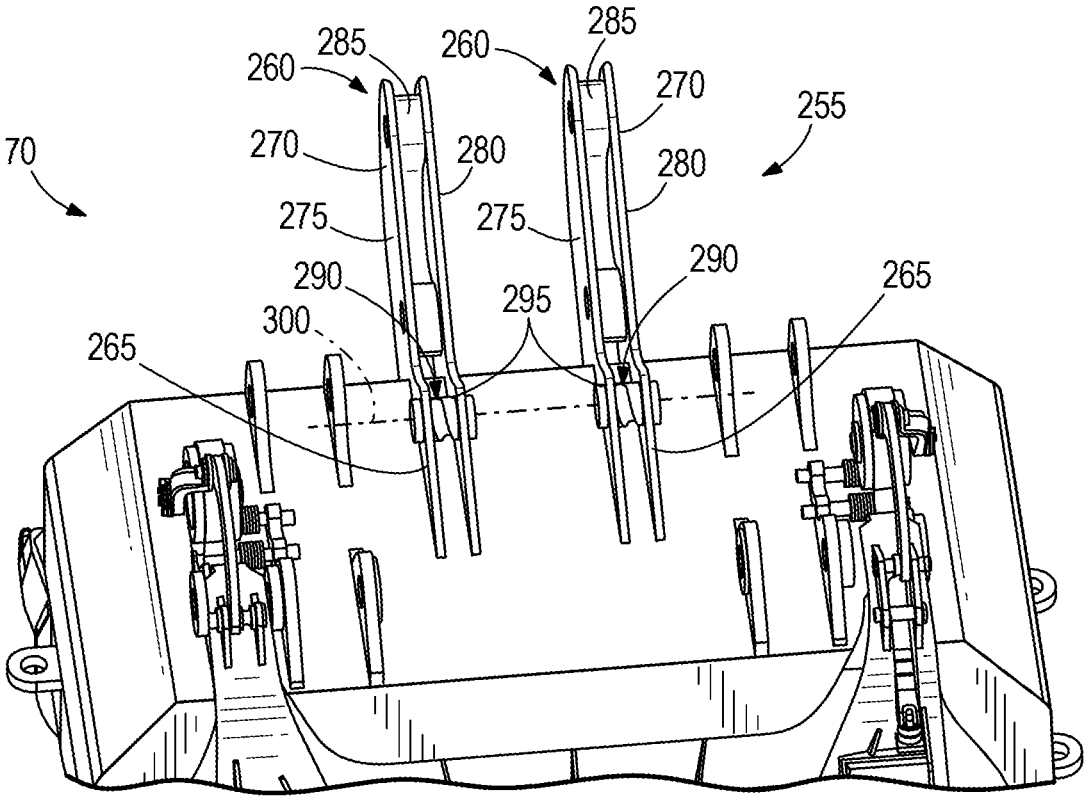
FIG. 6 is a partial, perspective view of the hoist rope attachment assembly of FIG. 5

However, the hoist rope attachment assembly 255 does not include a D-block to receive the hoist rope(s) 80. Instead, the hoist rope attachment assembly 255 instead includes pins 290 to receive the hoist rope(s) 80. Each of the pins 290 extends between the first plate 275 and the second plate 280 in the first portion 265 of the cam 260. In the illustrated construction, the first and second plates 275, 280 include openings 295 in the first portion 265 that are sized to receive the pins 290. When the pins 290 are inserted through the openings 295, the pins 290 are aligned along a longitudinal axis 300 (FIG. 6).

Figure 7:
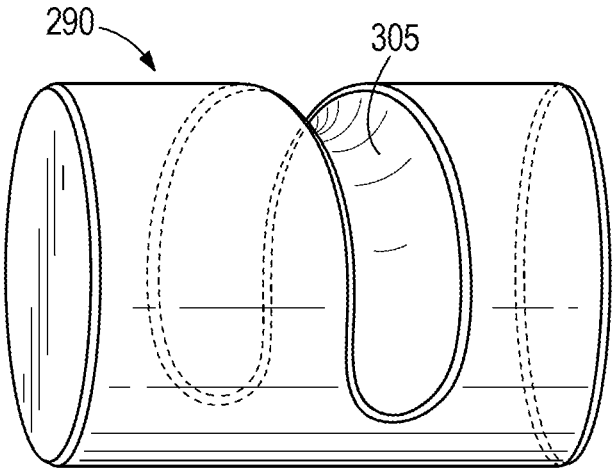
FIG. 7 is a perspective view of a pin of the hoist rope attachment assembly of FIG. 5.
Figure 8:
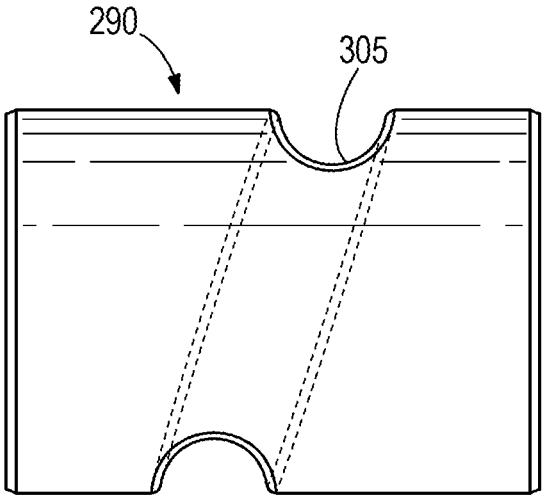
FIG. 8 is a side view of the pin of FIG. 7.

With reference to FIGS. 7 and 8, each pin 295 includes a groove 305 that is sized to receive and guide the hoist rope(s) 80. In the illustrated construction, the groove 305 extends partially around the pin 290, and is positioned at an oblique angle relative to the longitudinal axis 300. In the illustrated construction, the groove 305 extends in a helical pattern around the pin 290. Other constructions include different arrangement and numbers of grooves 305.

In some constructions, one hoist rope 80 extends from the sheave 65, contacts one of the rope guides 285, extends within the groove 305 in one of the pins 290, and then terminates at the pin 290 or elsewhere on the dipper 70 (e.g., attaches to the pin 290 within the groove 305 or at another location on the pin 290). A second hoist rope 80 extends from the sheave 65, contacts the other rope guide 285, extends within the groove 305 in the other pin 290, and then terminates at the pin 290 or elsewhere on the dipper 70 (e.g., attaches to the pin 290 within the groove 305 or at another location on the pin 290). Other constructions include different numbers of hoist ropes 80 (e.g., four or more hoist ropes 80), as well as different windings and positions of the hoist rope(s) 80 on the hoist rope attachment assembly 255.

FIGS. 9-16 illustrate another hoist rope attachment assembly 355. The hoist rope attachment assembly 355 is for retrofit use on a dipper 360 that normally relies on an equalizer to couple the hoist rope(s) 80 to the dipper 360. The dipper 360 includes flanges 365 normally designed for receiving the equalizer (not shown). The hoist rope attachment assembly 355 is instead coupled to these flanges 365.

Figure 13:
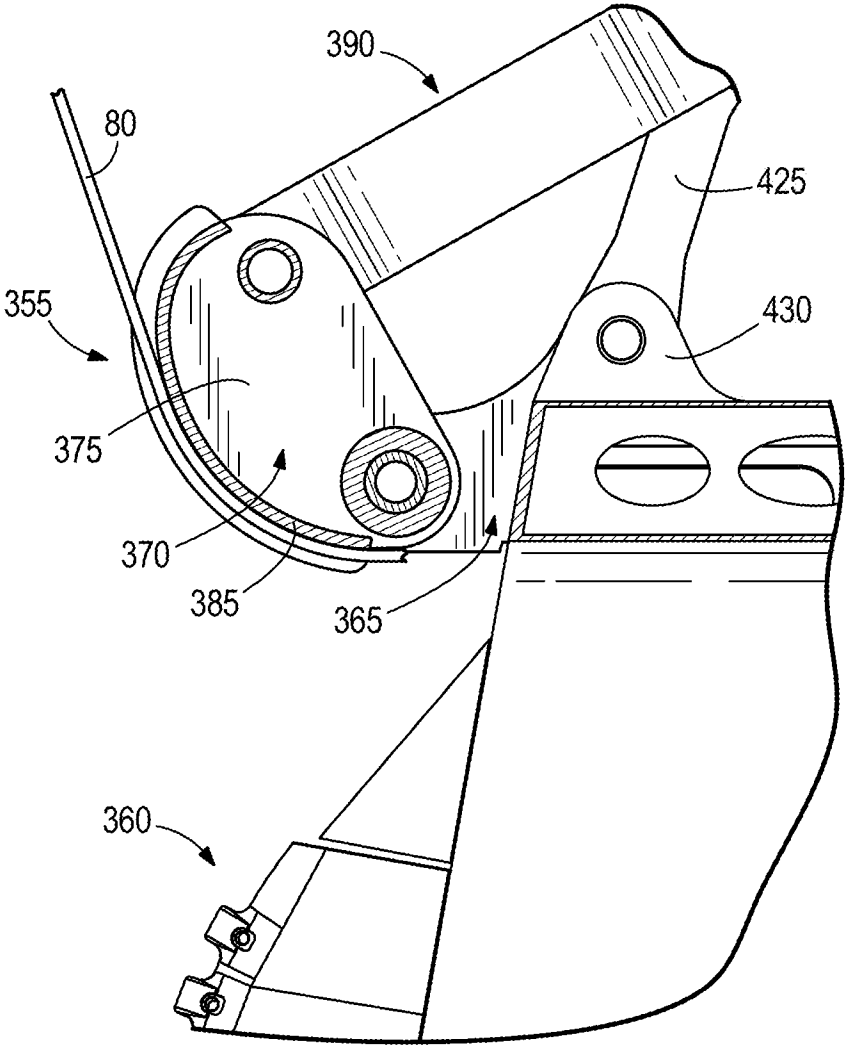
FIG. 13 is a partial, side view of the hoist rope attachment assembly of FIG. 9, with a portion of the hoist rope attachment assembly removed.
Figure 12:
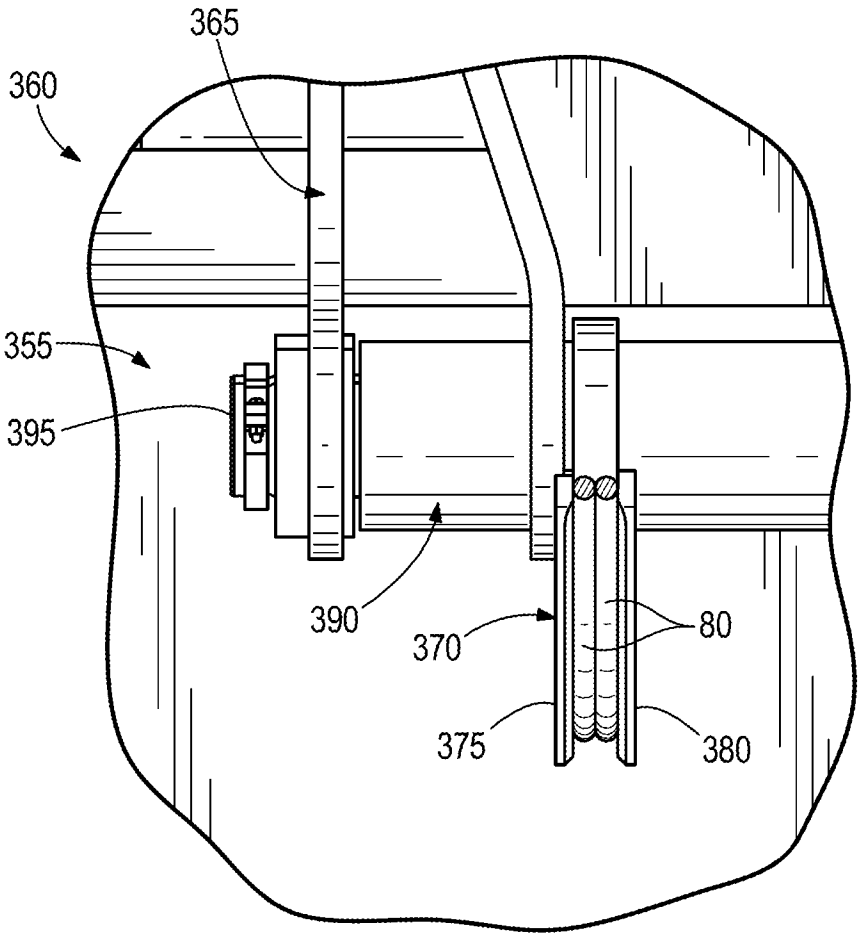
FIG. 12 is a partial, enlarged view of the hoist rope attachment assembly of FIG. 9

As with the hoist rope attachment assemblies 155, 255, the hoist rope attachment assembly 355 couples the hoist rope(s) 80 directly to the dipper 360 itself. The hoist rope attachment assembly 355 includes cams 370 having first and second plates 375, 380, and rope guides 385 disposed between the first and second plates 375, 380, similar to the hoist rope assemblies 155, 255. FIGS. 12 and 13, for example, illustrate hoist ropes 80 contacting the rope guide 385 and being disposed between the first and second plates 375, 380.

In contrast to the attachment assemblies 155, 255, the cams 370 are disposed on a single cam supporting structure 390, a portion of which extends between the two flanges 365 of the dipper 360. A standard equalizer pin or cartridge 395 is inserted through each flange 365 to hold the cam supporting structure 390 in place on the dipper 360.

Figure 9:
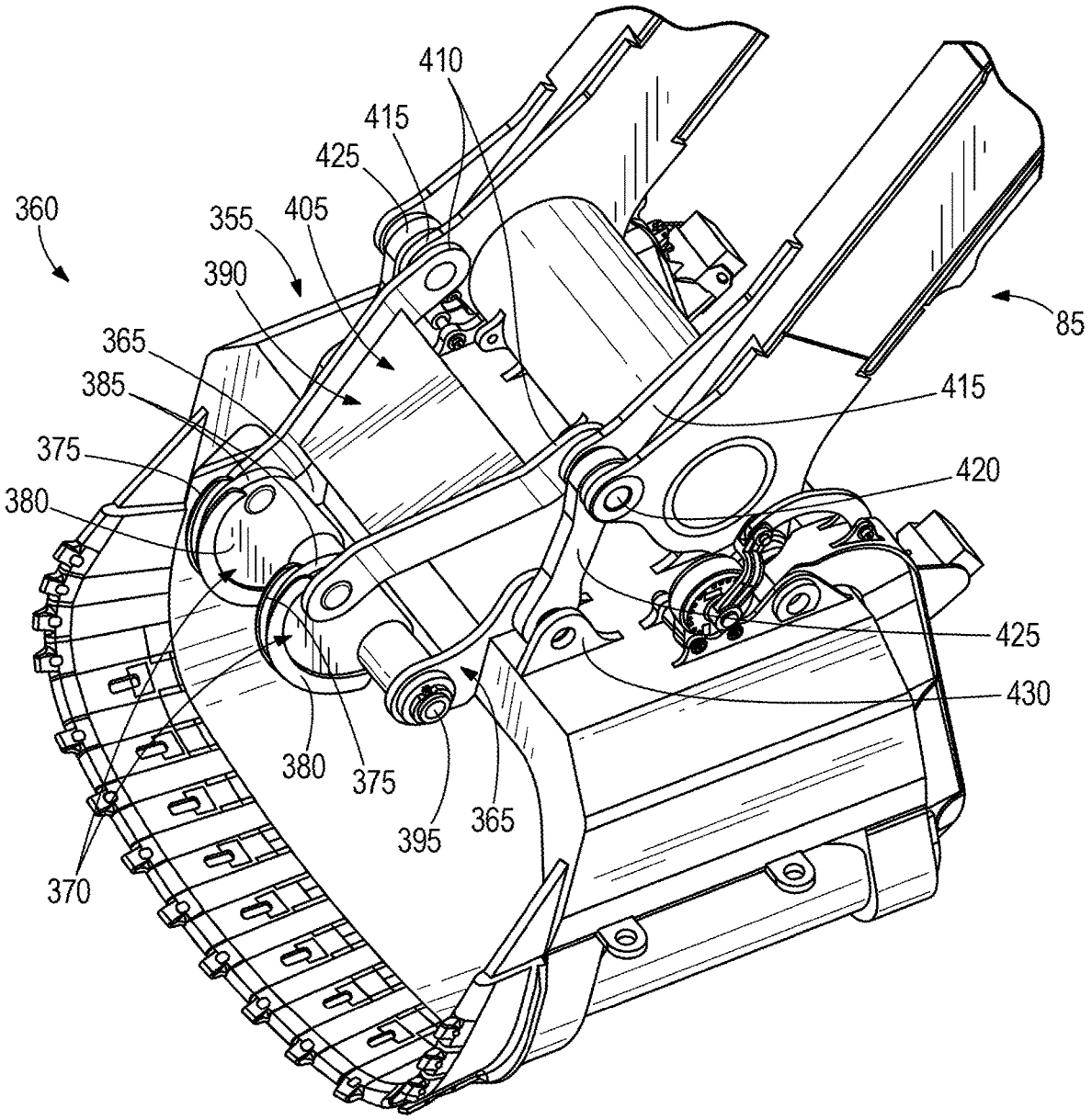
FIG. 9 is a perspective view of a dipper having a hoist rope attachment assembly according to another construction, the hoist rope attachment assembly being used as a retrofit.
Figure 10:
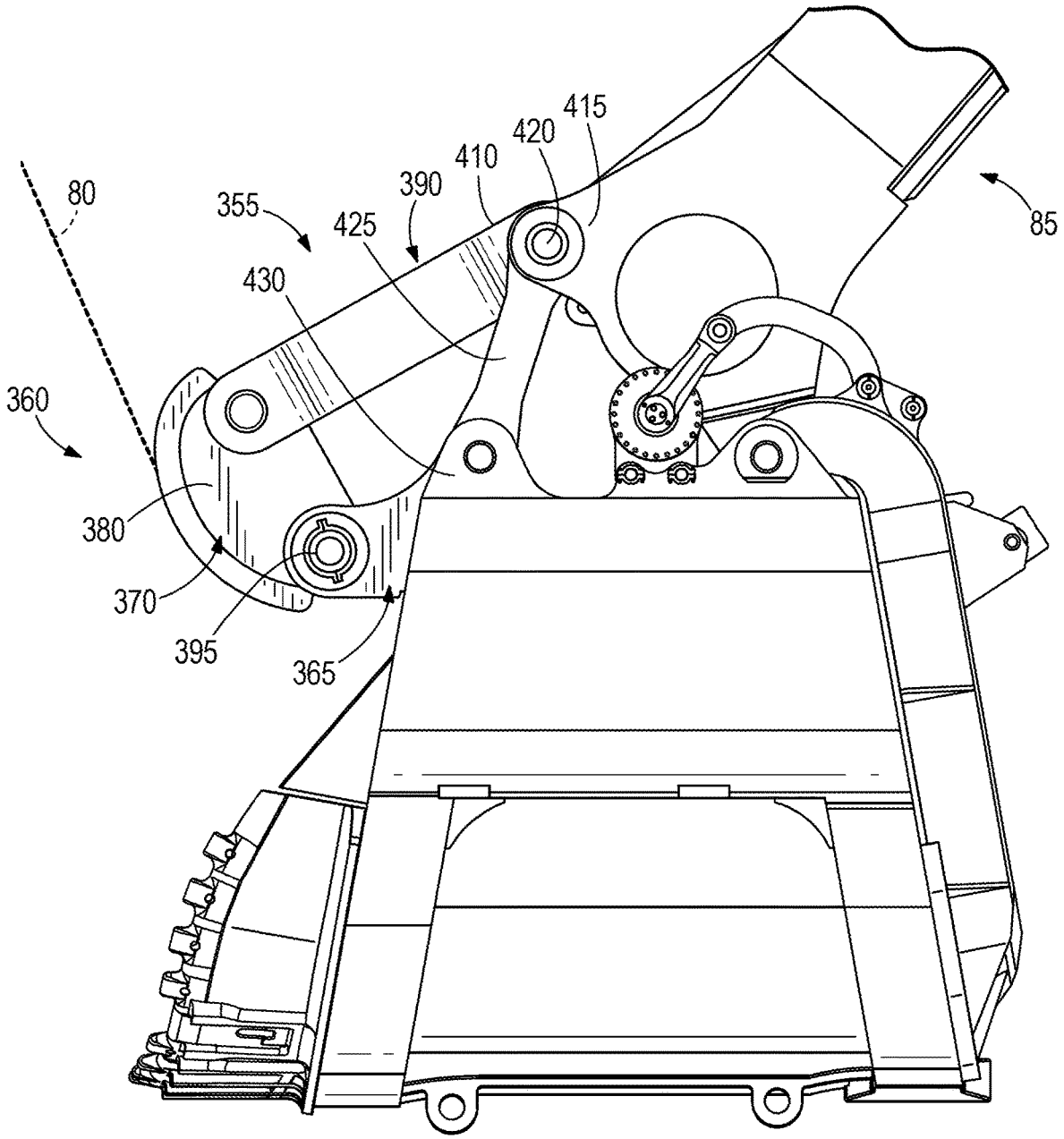
FIG. 10 is a side view of the hoist rope attachment assembly of FIG. 9.
Figure 11:
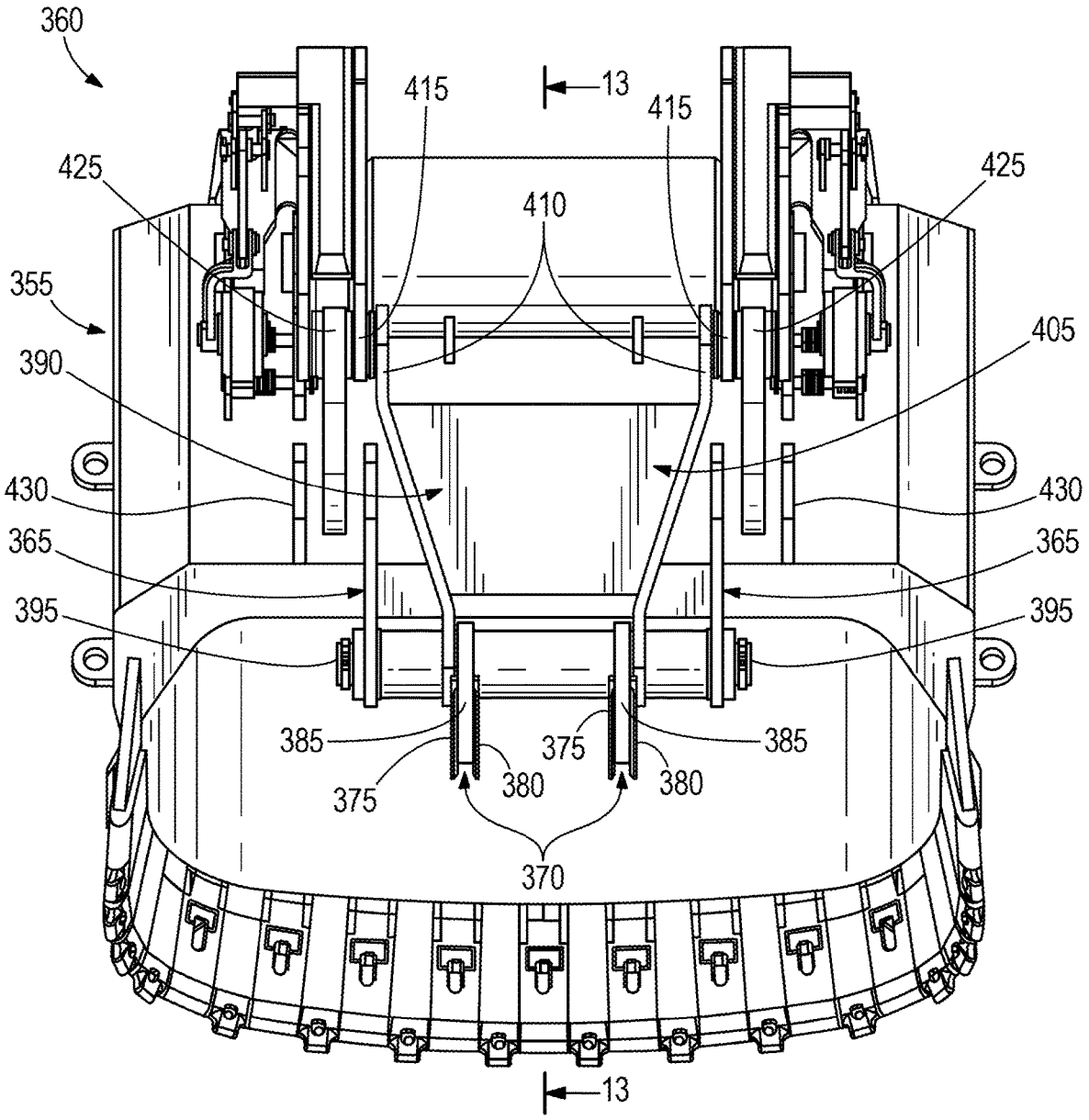
FIG. 11 is a perspective view of the hoist rope attachment assembly of FIG. 9.

With reference to FIG. 9, the cam supporting structure 390 also includes a cam brace 405, which includes flanges 410 that are coupled to corresponding flanges 415 on the dipper arm 85 with pins 420. Standard pitch braces 425 are also coupled to the flanges 415 on the dipper arm 85, and to flanges 430 on the dipper 360, with one or more pinned connections.

Figure 15:
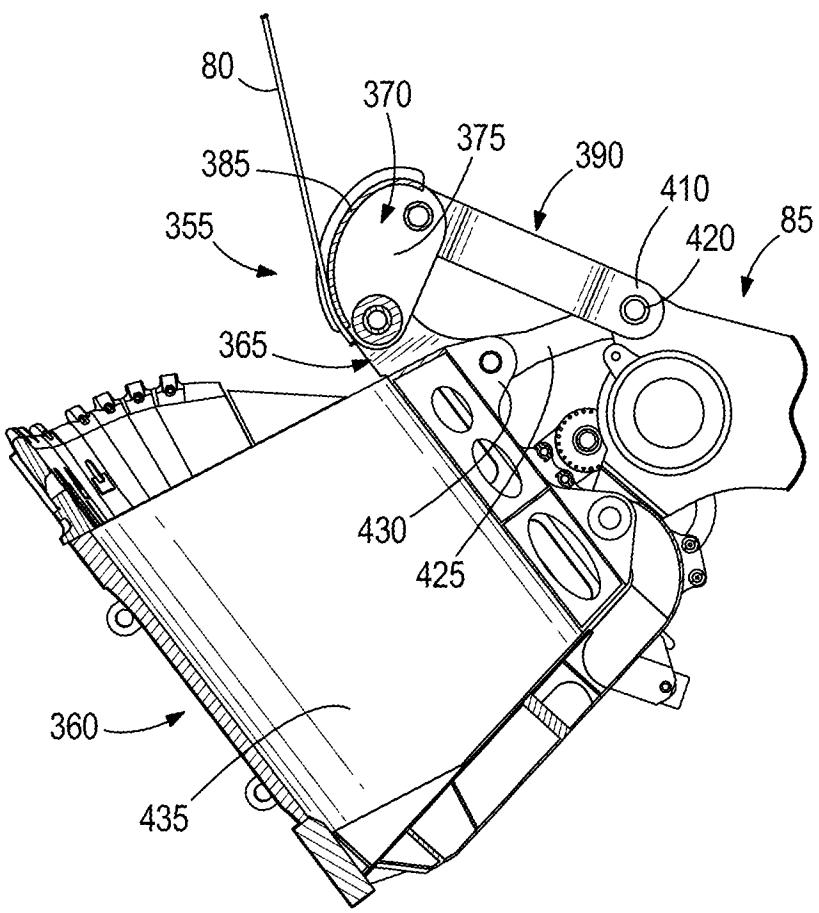
FIG. 15 is a side view of the hoist rope attachment assembly of FIG. 9 in a second position.
Figure 14:
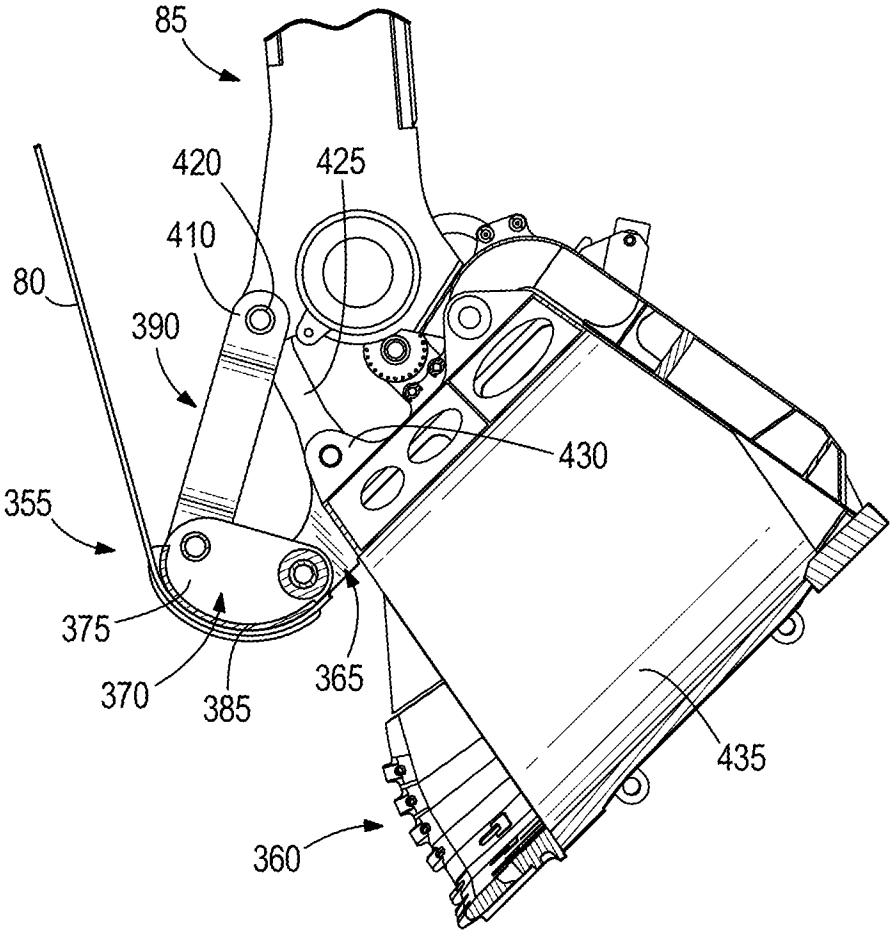
FIG. 14 is a side view of the hoist rope attachment assembly of FIG. 9 in a first position.

With reference to FIGS. 14 and 15, the cam supporting structure 390 rotates with the dipper 360 via the pins 420, such that the cams 370 remain at a constant position relative to a main body 435 of the dipper 360, regardless of the orientation of the main body 435. The cams 370 thus form part of the overall dipper 360, and provide a structure by which the hoist rope(s) 80 may be attached directly to the dipper 360.

Figure 16:
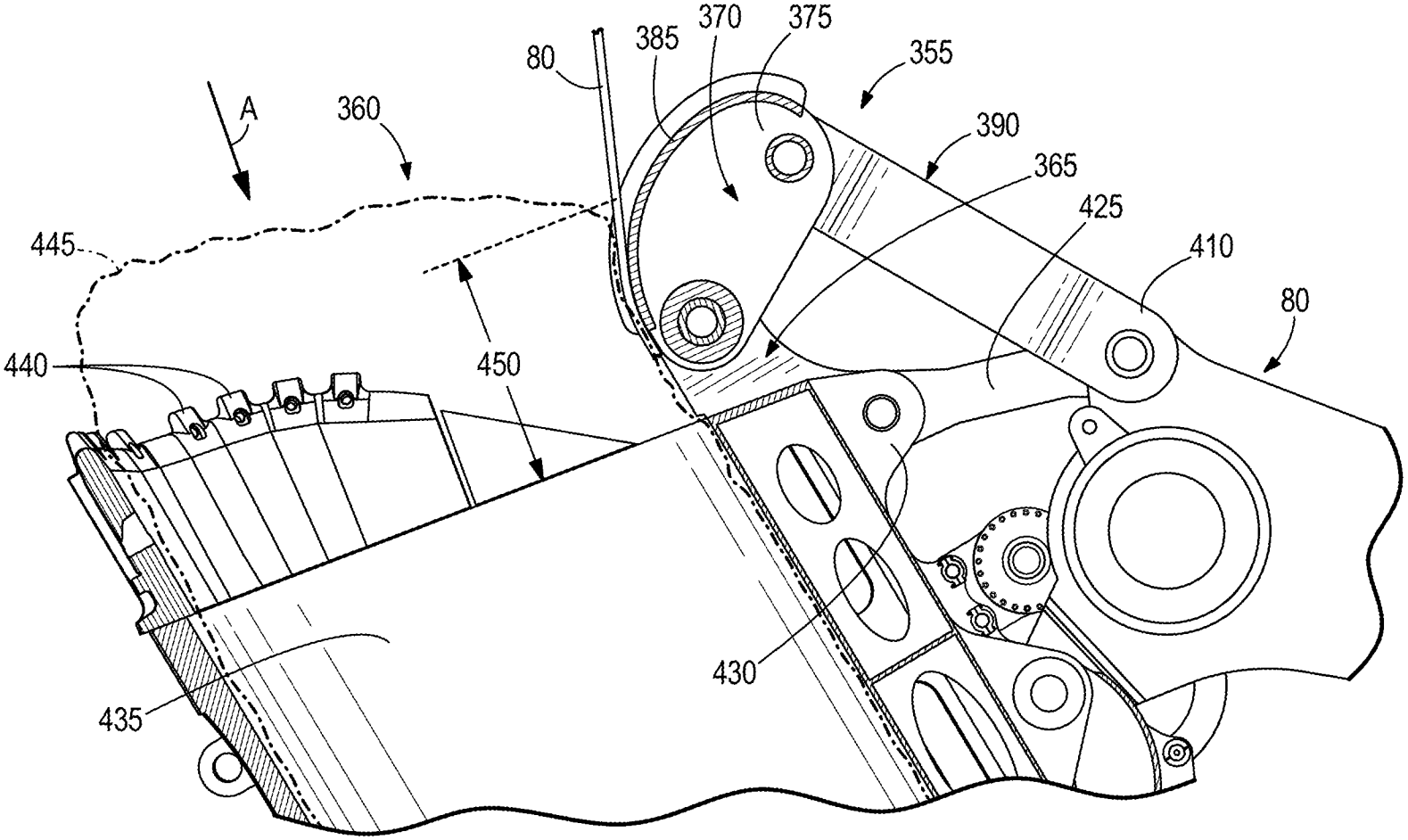
FIG. 16 is a partial side view of the hoist rope attachment assembly of FIG. 9, showing material disposed within the dipper.

With reference to FIG. 16, the cams 370 are also positioned so as to not interfere with the loading of material into the dipper 360. Thus, while portions of the cams 370 extend away from the main body 435 of the dipper (similar to the second portions 170 described above), the cams 370 do not adversely interfere with material entering the dipper 360. For example, as illustrated in FIG. 16, the cams 370 generally extend in a direction away from digging teeth 440, thereby leaving a large area within which material 445 may enter along a direction "A" into the dipper 360. A distance 450 extends from the main body 435 to an area where the hoist rope(s) 80 deviates or exits from the cam 370. As illustrated in FIG. 16, this distance 450 provides sufficient room for material 445 to enter and be gathered in the dipper 360, yet to not contact or interfere with the portion of the hoist rope(s) 80 that is exposed outside of the cams 370.

Figure 17:
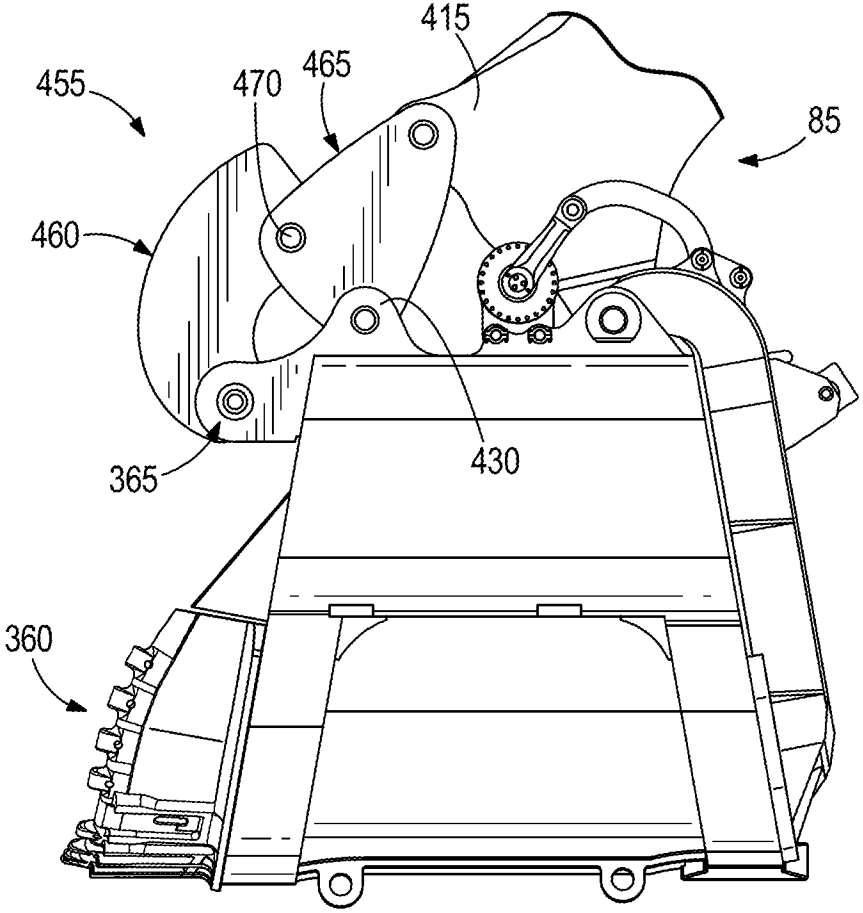

FIG. 17 illustrates another hoist rope attachment assembly 455. The hoist rope attachment assembly 455 is also for retrofit use on the dipper 360, and includes cams 460 (e.g., the same as cams 370). In contrast to the hoist rope attachment assembly 355, however, the hoist rope attachment assembly 455 uses a modified, or enlarged, pitch brace 465 as a cam supporting structure. The pitch brace 465 couples not only to the flanges 415 on the dipper arm 85 and to the flanges 430 on the dipper 360, but also couples directly to the cams themselves 460 at a connection 470 (e.g., a pinned connection).

Figure 18:
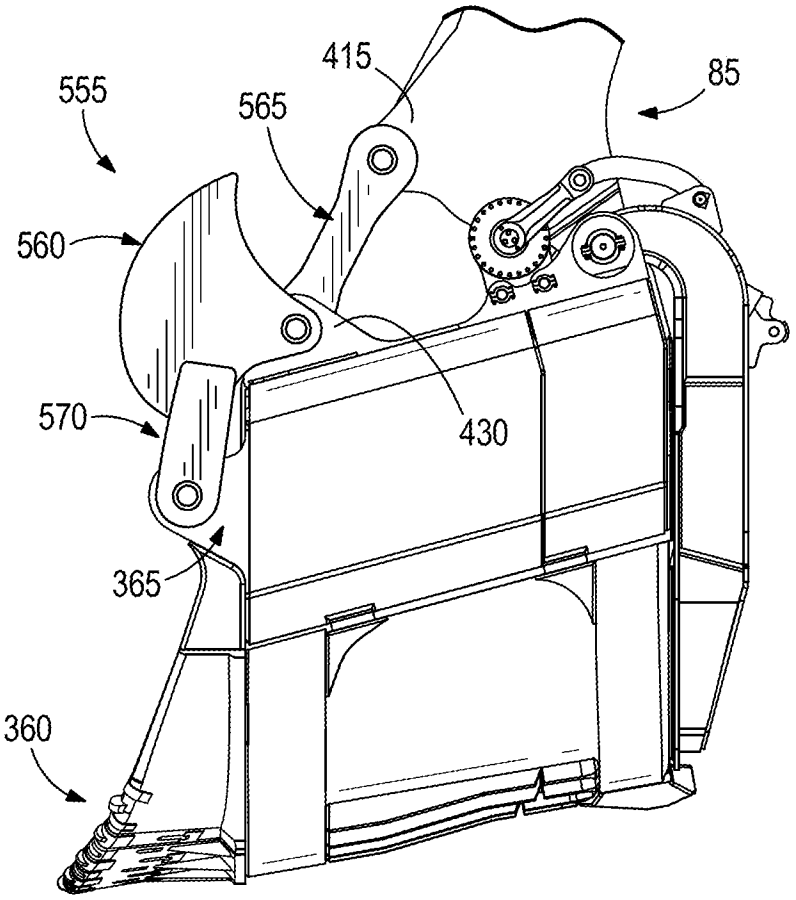
FIGS. 17 and 18 are side views of hoist rope attachment assemblies according to other constructions.

FIG. 18 illustrates another hoist rope attachment assembly 555. The hoist rope attachment assembly 555 is also for retrofit use on the dipper 360, and includes cams 560. In the illustrated construction, the cams 560 have a slightly different profile and radius of curvature than the cams 460 and 370. However, as noted above, the cams of the various hoist rope attachment assemblies described herein may have various types of shapes, profiles, and radii of curvature. Pitch braces 565 are coupled to both the flanges 415 on the dipper arm 85, and to the flanges 430 on the dipper 360. Further support arms 570 are also provided as cam supporting structures, and are coupled (e.g., welded) to both the flanges 365 on the dipper 360 and to the cams 560 to add further stability and to secure the positioning of the cams 560.

Although the invention has been described in detail with reference to certain preferred embodiments, variations and modifications exist within the scope and spirit of one or more independent aspects of the invention as described.

What is claimed is:

1. A mining machine assembly comprising:

a boom;

a sheave rotatably mounted on an upper end of the boom;

a dipper having a main body, the main body having a front side, a back side, a bottom side, and a top side, wherein a ground engagement portion extends forwardly from the front side, the ground engagement portion including digging teeth; and a hoist rope attachment assembly coupled to the dipper, wherein the hoist rope attachment assembly is configured to directly couple a hoist rope that is wrapped about the sheave to the dipper, and wherein the hoist rope attachment assembly includes a projecting structure configured to support the hoist rope, the projecting structure having a first portion extending upwardly and away from the top side of the main body of the dipper, and the projecting structure having a second portion that extends from the first portion both forwardly and away from the main body, wherein the second portion includes a rope guide configured to support the hoist rope.

2. The mining machine assembly of claim 1, wherein the projecting structure includes a first plate, a second plate, and wherein the rope guide is disposed between the first plate and the second plate.

3. The mining machine assembly of claim 2, wherein the rope guide is removably coupled to the first and second plates.

4. The mining machine assembly of claim 2, wherein the first plate and the second plate are equal in size and shape, and extend parallel to one another.

5. The mining machine assembly of claim 2, wherein the rope guide has a C-shaped profile.

6. The mining machine assembly of claim 2, wherein the first plate has a first curved outer surface, the second plate has a second curved outer surface, and the rope guide has a third curved outer surface, and wherein the third curved outer surface is configured to contact and guide the hoist rope.

7. The mining machine assembly of claim 6, wherein the third curved outer surface has a constant radius of curvature.

8. The mining machine assembly of claim 1, wherein the hoist rope attachment assembly is rigidly affixed to the dipper.

9. The mining machine assembly of claim 2, wherein a constant gap exists between an outer surface of the rope guide and outer surfaces of the first plate and the second plate.

10. The mining machine assembly of claim 9, wherein the gap forms a channel configured to receive the hoist rope.

11. The mining machine assembly of claim 1, wherein the hoist rope attachment assembly further includes a D-block coupled to the cam.

12. The mining machine assembly of claim 11, wherein the projecting structure is a first projecting structure, wherein the hoist rope attachment assembly includes a second projecting structure, and wherein the D-block extends between the first projecting structure and the second projecting structure.

13. The mining machine assembly of claim 11, wherein the D-block includes a channel configured to receive the hoist rope.

14. The mining machine assembly of claim 13, wherein the channel is a first channel, and wherein the D-block includes a second channel configured to receive the hoist rope.

15. The mining machine assembly of claim 2, wherein the hoist rope attachment assembly further includes a pin configured to receive the hoist rope, wherein the pin extends between the first plate and the second plate in the first portion of the projecting structure.

16. The mining machine assembly of claim 15, wherein the pin is aligned along a longitudinal axis, and wherein the pin includes a groove that extends at least partially around the pin at an oblique angle relative to the longitudinal axis.

17. The mining machine assembly of claim 1, further comprising the hoist rope, wherein the hoist rope is wrapped over the sheave and is coupled directly to the second portion of the projecting structure.

18. The mining machine assembly of claim 17, wherein the rope guide is stationary and fixed relative to the main body of the dipper.

19. A kit including the mining machine assembly of claim 2, wherein the rope guide is a first rope guide having an outer surface with a first radius of curvature, and wherein the mining machine assembly includes a second rope guide having an outer surface with a second radius of curvature, wherein the second radius of curvature is different than the first radius of curvature, and wherein the first rope guide is replaceable with the second rope guide.

20. An assembly for use on a mining machine, the assembly comprising:

a dipper having a main body, the main body having a front side, a back side, a bottom side, and a top side, wherein a ground engagement portion extends from the front side, the ground engagement portion including digging teeth; and a hoist rope attachment assembly coupled to the dipper, wherein the hoist rope attachment assembly is configured to directly couple a hoist rope to the dipper, wherein the hoist rope attachment assembly includes a projecting structure having a first portion extending away from the top side of the main body of the dipper, and the projecting structure having a second portion that extends from the first portion and away from the main body and digging teeth, wherein the hoist rope attachment assembly further includes a D-block coupled to the projecting structure, wherein the projecting structure is a first projecting structure, wherein the hoist rope attachment assembly includes a second projecting structure, and wherein the D-block extends between the first projecting structure and the second projecting structure.

21. An assembly for use on a mining machine, the assembly comprising:

a dipper having a main body, the main body having a front side, a back side, a bottom side, and a top side, wherein a ground engagement portion extends from the front side, the ground engagement portion including digging teeth; and a hoist rope attachment assembly coupled to the dipper, wherein the hoist rope attachment assembly is configured to directly couple a hoist rope to the dipper, wherein the hoist rope attachment assembly includes a projecting structure having a first portion extending away from the top side of the main body of the dipper, and the projecting structure having a second portion that extends from the first portion and away from the main body and digging teeth, wherein the hoist rope attachment assembly further includes a D-block coupled to the cam, and wherein the D-block includes a channel configured to receive the hoist rope.

22. An assembly for use on a mining machine, the assembly comprising:

a dipper having a main body, the main body having a front side, a back side, a bottom side, and a top side, wherein a ground engagement portion extends from the front side, the ground engagement portion including digging teeth; and a hoist rope attachment assembly coupled to the dipper, wherein the hoist rope attachment assembly is configured to directly couple a hoist rope to the dipper, wherein the hoist rope attachment assembly includes a projecting structure having a first portion extending away from the top side of the main body of the dipper, and the projecting structure having a second portion that extends from the first portion and away from the main body and digging teeth, wherein the projecting structure includes a first plate, a second plate, and a rope guide disposed between the first plate and the second plate, wherein the hoist rope attachment assembly further includes a pin configured to receive the hoist rope, wherein the pin extends between the first plate and the second plate in the first portion of the cam, and wherein the pin is aligned along a longitudinal axis, and wherein the pin includes a groove that extends at least partially around the pin at an oblique angle relative to the longitudinal axis.

* * * * *